US006322327B1

(12) United States Patent
Dawson et al.

(10) Patent No.: US 6,322,327 B1
(45) Date of Patent: Nov. 27, 2001

(54) JET PUMP FOR TRANSFER OF MATERIAL

(75) Inventors: Richard F. Dawson, Clinton; Robert J. Hutchinson, Baton Rouge, both of LA (US)

(73) Assignee: Walker-Dawson Interests, Inc., Clinton, LA (US)

( * ) Notice: Subject to any disclaimer, the term of this patent is extended or adjusted under 35 U.S.C. 154(b) by 0 days.

(21) Appl. No.: 09/482,995

(22) Filed: Jan. 13, 2000

(51) Int. Cl.[7] ..... F04F 5/44; F04F 9/00; F04F 5/48

(52) U.S. Cl. ..... 417/198; 417/158; 417/187; 417/189

(58) Field of Search ..... 417/198, 158, 417/187, 189

(56) References Cited

U.S. PATENT DOCUMENTS

| | | | | |
|---|---|---|---|---|
| 86,152 | | 1/1869 | Hancock | 417/151 |
| 137,507 | | 4/1873 | Thayer | 406/153 |
| 250,073 | | 11/1881 | Hudson | 417/84 |
| 368,691 | | 8/1887 | See | 114/184 |
| 436,932 | | 9/1890 | Best | 417/174 |
| 550,244 | | 11/1895 | Blagburn | 417/174 |
| 640,463 | | 1/1900 | Gildea | 417/172 |
| 694,002 | | 2/1902 | Davis | 406/153 |
| 2,044,088 | | 6/1936 | Lord | 417/151 |
| 2,191,424 | | 2/1940 | Cardinal | 417/170 |
| 2,196,859 | | 4/1940 | Godfrey | 37/308 |
| 2,616,614 | | 11/1952 | Plummer, Jr. | 230/95 |
| 2,632,597 | | 3/1953 | Boeckeler | 230/92 |
| 3,877,238 | * | 4/1975 | Chang et al. | 417/153 |
| 3,922,112 | * | 11/1975 | Miscovich | 417/54 |
| 4,165,571 | | 8/1979 | Chang | 37/322 |
| 4,186,772 | * | 2/1980 | Handleman | 417/197 |
| 4,316,680 | | 2/1982 | Phipps | 406/49 |
| 4,681,372 | | 7/1987 | McClure | 299/8 |
| 5,012,984 | | 5/1991 | Ishikawa | 241/16 |
| 5,478,209 | | 12/1995 | McDonough | 417/174 |
| 5,522,419 | * | 6/1996 | Sand | 137/216 |
| 5,628,623 | | 5/1997 | Skaggs | 417/151 |
| 5,667,365 | | 9/1997 | Miller | 417/151 |
| 5,811,013 | | 9/1998 | Ito | 210/705 |
| 5,957,665 | | 9/1999 | Kanzler et al. | 417/55 |
| 5,993,167 | | 11/1999 | Mochizuki | 417/174 |
| 6,017,195 | | 1/2000 | Skaggs | 417/181 |

FOREIGN PATENT DOCUMENTS

| | | | |
|---|---|---|---|
| 0178873 | | 4/1986 | (EP) . |
| 122278 | * | 2/1919 | (GB) . |
| 51140206 | | 12/1976 | (JP) . |
| 5442682 | | 12/1979 | (JP) . |
| 62223296 | | 10/1987 | (JP) . |
| 3151422 | | 6/1991 | (JP) . |
| 5245355 | | 9/1993 | (JP) . |
| 8028500 | | 1/1996 | (JP) . |
| 10009216 | | 1/1998 | (JP) . |

* cited by examiner

*Primary Examiner*—Timothy S. Thorpe
*Assistant Examiner*—Michael K. Gray
(74) *Attorney, Agent, or Firm*—Sieberth & Patty, LLC

(57) ABSTRACT

An improved liquid jet pump for moving solid or other materials is provided. The liquid jet pump includes a nozzle assembly, a suction chamber, and a target tube. The nozzle assembly pulls in atmospheric air, causing an air bearing effect around the liquid jet exiting the nozzle assembly. The liquid jet passes through the suction chamber with minimal deflection, reducing cavitation and improving mixing as educted materials enters the suction chamber and combines with the liquid jet. The combined material is directed into the target tube, which is designed to detach from the other components and is composed of abrasion-resistant material. The target tube absorbs the majority of wear, and provides ease of changing parts.

22 Claims, 9 Drawing Sheets

JET PUMP FOR TRANSFER OF MATERIAL

BACKGROUND OF THE INVENTION

1. Field of The Invention

This invention relates, generally, to hydraulic nonmechanical pumping devices for transferring material, and specifically, to an air-assisted liquid jet pump for moving solid materials.

2. Description of Related Art

The dredging industry commonly utilizes large centrifugal pumps for suction and movement of slurry material, i.e., water containing varying particle sizes such as sand or gravel. Because of the abrasive effect caused by particles, these pumps suffer wear and tear and significant downtime to repair parts of the equipment.

Removal of solid materials from a water environment by means of hydraulic operations is well known in the art. Dredging and deep sea mining operations employ water forced through piping configurations to cause an upward flow that pulls the water and solid material from the desired location.

A common problem in using jet eductor systems occurs because high pressure water jets, while effective at removing high volumes of slurry material, cause severe cavitation in the throat and mixing regions of the eductor conduit, and result in lowered efficiency and extremely short equipment life, as discussed in U.S. Pat. No. 4,165,571.

Use of air to induce upward flow of water has also been used. Use has typically involved compressed air or gas, requiring expensive compression equipment. In addition, the combination of gas, water and solids has contributed to process instability in the mixing chamber of the device, as discussed in U.S. Pat. No. 4,681,372.

Jet eduction systems have used atmospheric air for the purpose of creating air bubbles for separation processes in U.S. Pat. No. 5,811,013. These systems were not designed to increase pump efficiency, prevent pump cavitation or increase pump flow as disclosed by the present invention. Prior art teaches against introduction of air for these purposes.

Cavitation is the term used to describe vapor bubble generation and collapse in pumps when the pressure in the pump suction drops to or below the NPSH for the pump. The same effects can be observed when air enters the liquid stream inlet of a pump. The presence of a gas in both circumstances causes reduced capacity, reduced or unstable head pressure, and unstable power consumption. Vibration, noise, accelerated corrosion, fatigue failure and other mechanical damage are the consequences of cavitation. The use of the term cavitation in this specification is intended to cover the resulting effects rather than define the physical circumstances causing these resulting effects.

OBJECTS OF THE INVENTION

It is an object of the present invention to provide a pumping means that increases the quantity of material moved without an increase in energy consumption.

It is another object of the present invention to provide a pumping means for moving solid materials with minimal wear on component parts.

It is another object of the present invention to overcome the problems associated with traditional venturi effect pumps.

It is another object of the present invention to provide a pump that has specific parts which are designed to wear and which can be easily changed.

It is another object of the invention to provide a pump that produces a vacuum for suctioning material with little or no cavitation.

SUMMARY OF THE INVENTION

An improved liquid jet pump for moving solid materials is provided. The liquid jet pump includes a nozzle assembly that pulls in atmospheric air. The liquid jet created by passage through the nozzle assembly has minimal deflection as it exits because of an atmospheric air bearing surrounding the liquid jet. Consequently, the liquid jet pump has improved efficiency and capacity.

The liquid jet pump also includes a suction chamber with a suction pipe. The suction generated in the chamber pulls in solid material through the suction pipe as the liquid jet from the nozzle assembly passes through the suction chamber. The liquid jet pump also includes a target tube that receives the liquid jet combined with materials from the suction pipe through the suction chamber. The target tube includes a housing support detachable from the suction chamber and is composed of a wear plate of abrasion-resistant material.

An advantage of the invention is that pump efficiency is improved by increasing the quantity of solid material moved without an increase in horsepower.

A further advantage of the invention is that the target tube wear plate is removable without requiring disassembly and repair of the entire pipe configuration.

A further advantage of the invention is that cavitation in the suction chamber is significantly reduced thereby reducing wear and increasing suction.

A feature of the invention is that conventional centrifugal pumps can be used downstream of the liquid jet pump to increase overall lift capacity.

A further feature of the invention is that it employs no moving parts that can provide potential ignition sources, permitting it to be safely used to pump flammable or volatile material.

These and other objects, advantages, and features of this invention will be apparent from the following description.

DETAILED DESCRIPTION OF THE INVENTION

Figure 1:
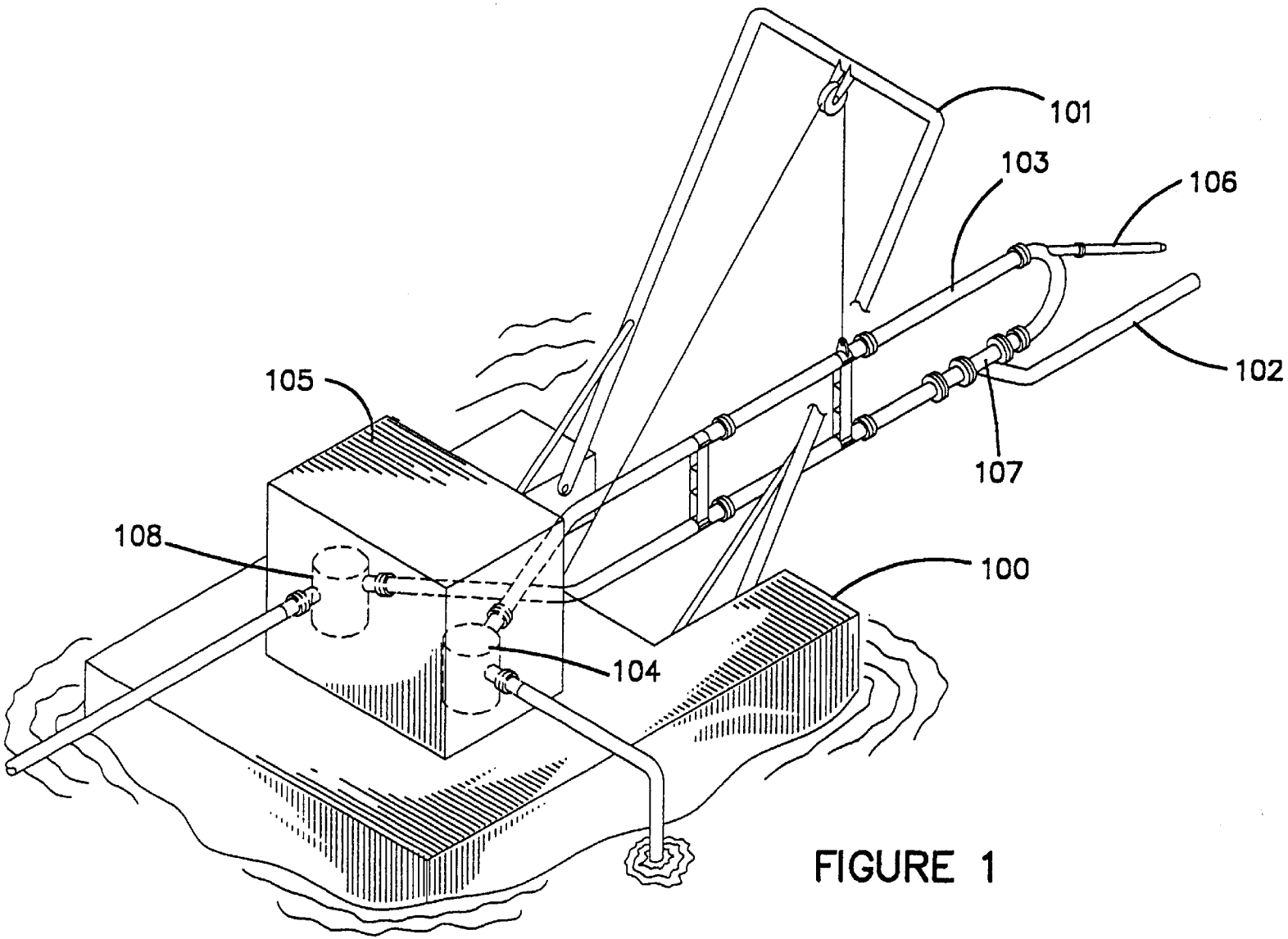
FIG. 1 is a plan view of a dredging assembly with an embodiment of the invention attached.

The embodiment of FIG. 1 illustrates barge 100 for dredging solid materials from a water source, such as a lake or river. Barge 100 is equipped with cantilever system 101 to raise and lower suction pipe 102 into the water source. Suction pipe 102 is connected to jet pump 107.

Discharge pipe 103 feeds water or other fluid pumped by pump 104 to jet pump 107. Pump 104 is typically a centrifugal pump, but can be any kind of pumping means, such as a positive displacement pump or even another jet pump. Pump 104 can be contained in pump housing 105. Discharge pipe 103 also feeds jet nozzle 106 which is connected to discharge pipe 103 before jet pump 107 and suction pipe 102.

Although suction pipe 102 is shown in FIG. 1 as defining an angled suction inlet 109 to jet pump 107 before becoming parallel to discharge pipe 103, suction pipe 102 can be 45° or any angle greater than 0° and less than 180° to discharge pipe 103 for the entire length of suction pipe 102. Centrifugal pump 108 can optionally be placed downstream of jet pump 107. Centrifugal pump 108 is typically a centrifugal pump but can be any pumping means.

The depiction of the invention for use in the dredging industry as reflected in FIG. 1 is only one example application for illustrative purposes. The jet pump 107 can vary in size, from handheld unit to mounted on a bulldozer, mudbuggy or other vehicle, for use in various applications. The distance between pump 104 and jet pump 107, i.e., the length of the discharge pipe, can also vary greatly.

Figure 2:
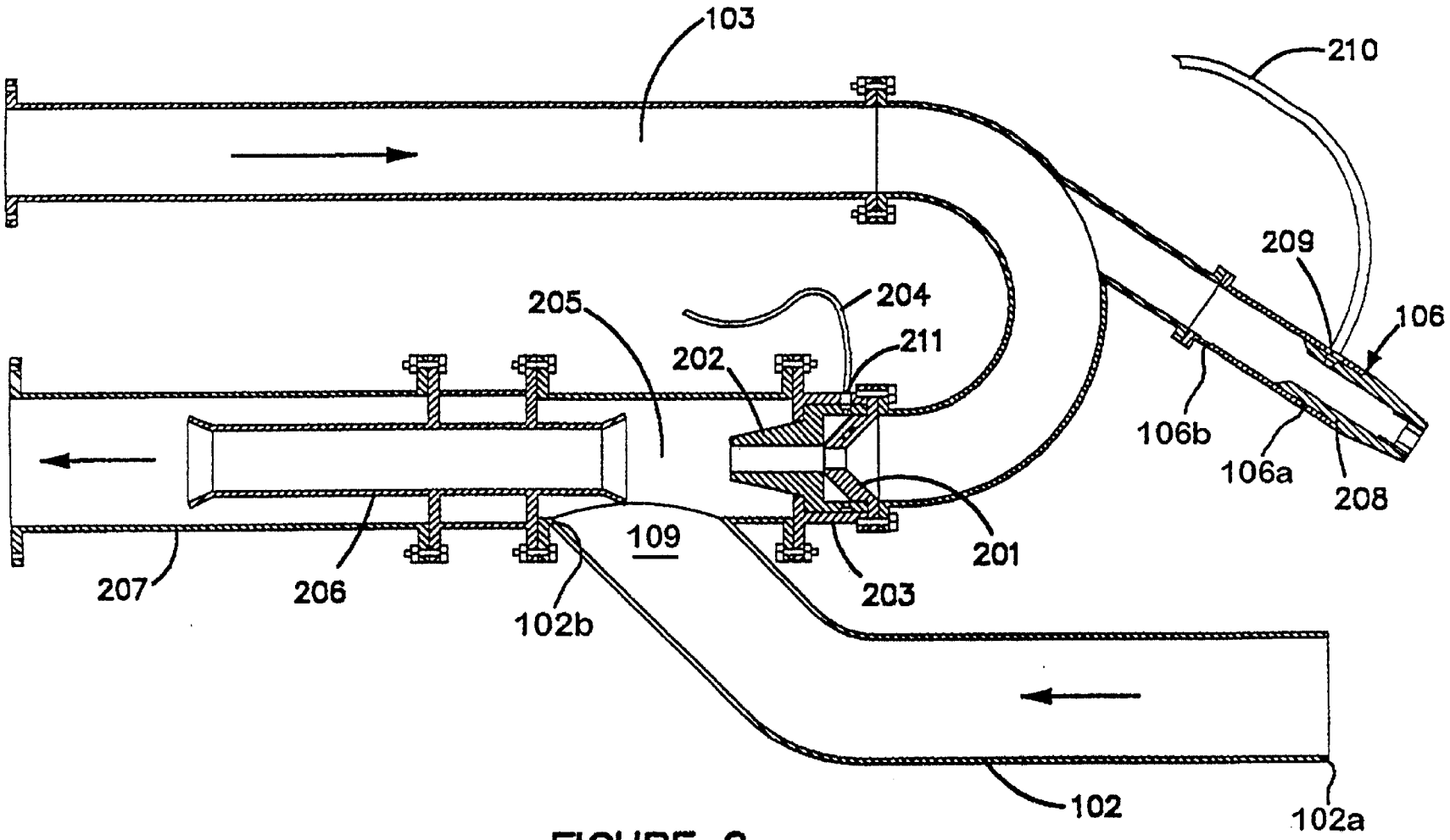
FIG. 2 is a sectional view of a preferred embodiment of the invention.

FIG. 2 illustrates a preferred embodiment of jet pump 107. Jet pump 107 includes nozzle assembly 307 (shown on FIG. 3) comprising fluid nozzle 201, air injection nozzle 202 and nozzle housing 203. Nozzle housing 203 is a flanged member which is attached to and maintains the proper position of fluid nozzle 201 adjacent to air injection nozzle 202. Air intake 211 is one or more passages through nozzle housing 203. In the embodiment depicted, a single air intake 211 is shown although those skilled in the art could use more. Air hose 204 allows jet pump 107 to use air even when below the water level.

Water or other fluid supplied by a pumping means passes through discharge pipe 103, fluid nozzle 201, and air injection nozzle 202 into suction chamber 205. In suction chamber 205, the fluid combines with material entering from suction pipe 102, and the combined stream enters target tube 206. The combined stream then passes through target tube 206 into outlet pipe 207.

In a preferred embodiment a first end 106*a* of jet nozzle 106 extends from discharge pipe 103, allowing a portion of the forced fluid supplied by pumping means to pass through jet nozzle 106. In a similar manner to the configuration for jet pump 107, jet nozzle 106 contains a venturi 208 at a second end 106*b* opposite the first end 106*a* connected to discharge pipe 103. Venturi 208 is equipped with air hose 210 to allow entry of atmospheric air through an air hole 209 defined by the second end 106*b* when jet pump 107 is submerged.

Jet nozzle 106 extends approximately the same length as suction pipe 102 and, as depicted in FIG. 1, terminates approximately one (1) foot from the open end of suction pipe 102. Fluid forced through jet nozzle 106 exits venturi 208 with air into the material that will be suctioned. An air bearing effect minimizes deflection and allows deeper penetration to loosen the material being transferred. The jet stream also creates a churning effect that directs the churned material into the open end of suction pipe 102.

Although jet nozzle 106 is shown in FIGS. 1 and 2 as a single attachment, in an alternate embodiment, multiples of jet nozzle 106 can be attached to discharge pipe 103. In another embodiment, one or more jet nozzles 106 can be attached to suction pipe 102, handheld, or mounted on other equipment, depending on the application.

Figure 3:
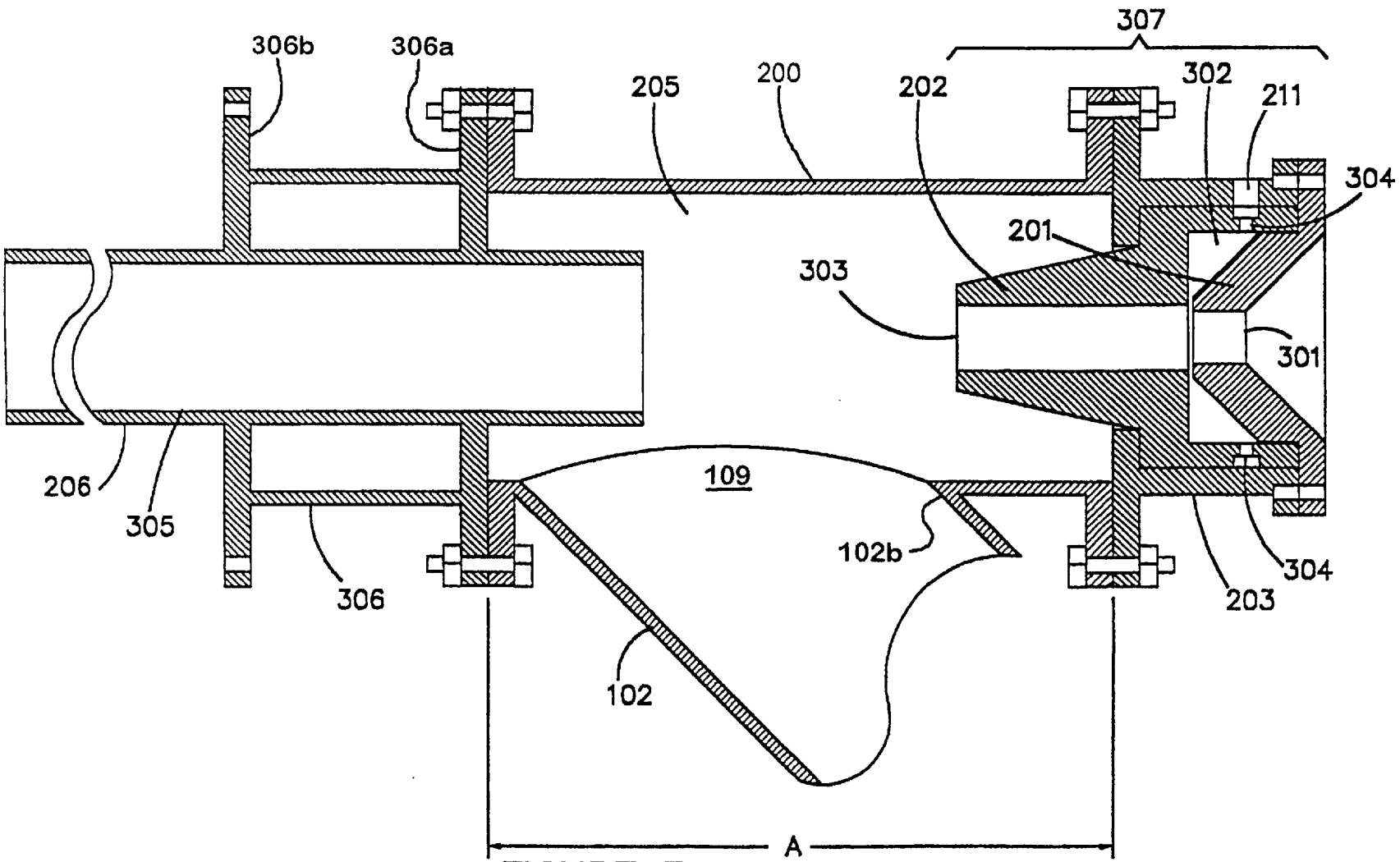
FIG. 3 is a sectional view of an embodiment of the nozzle assembly, suction chamber and target tube of the invention.
Figure 4A:
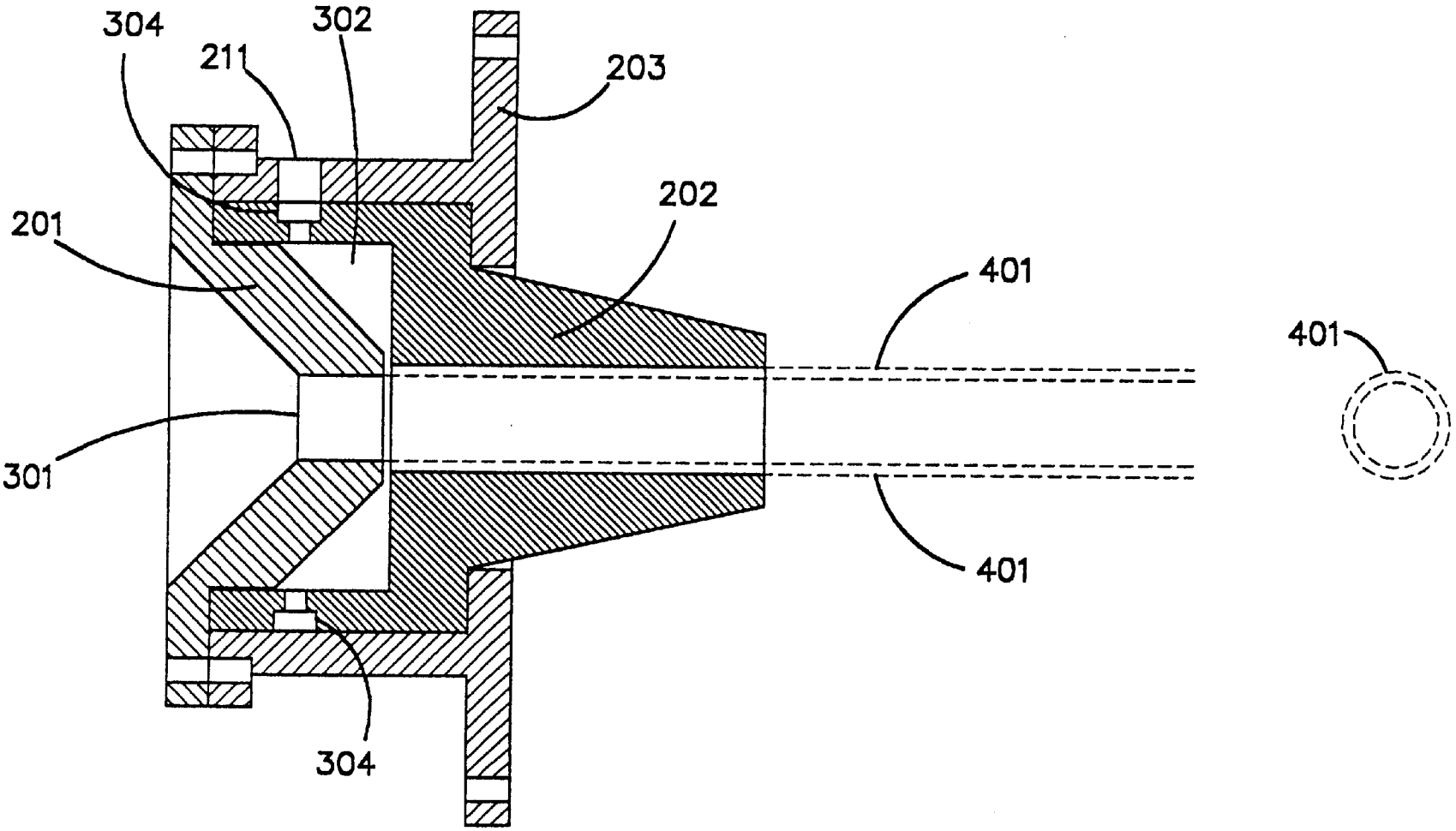
FIG. 4A is a sectional view of preferred embodiment of the nozzle assembly showing minimal deflection of the liquid jet.
Figure 4B:
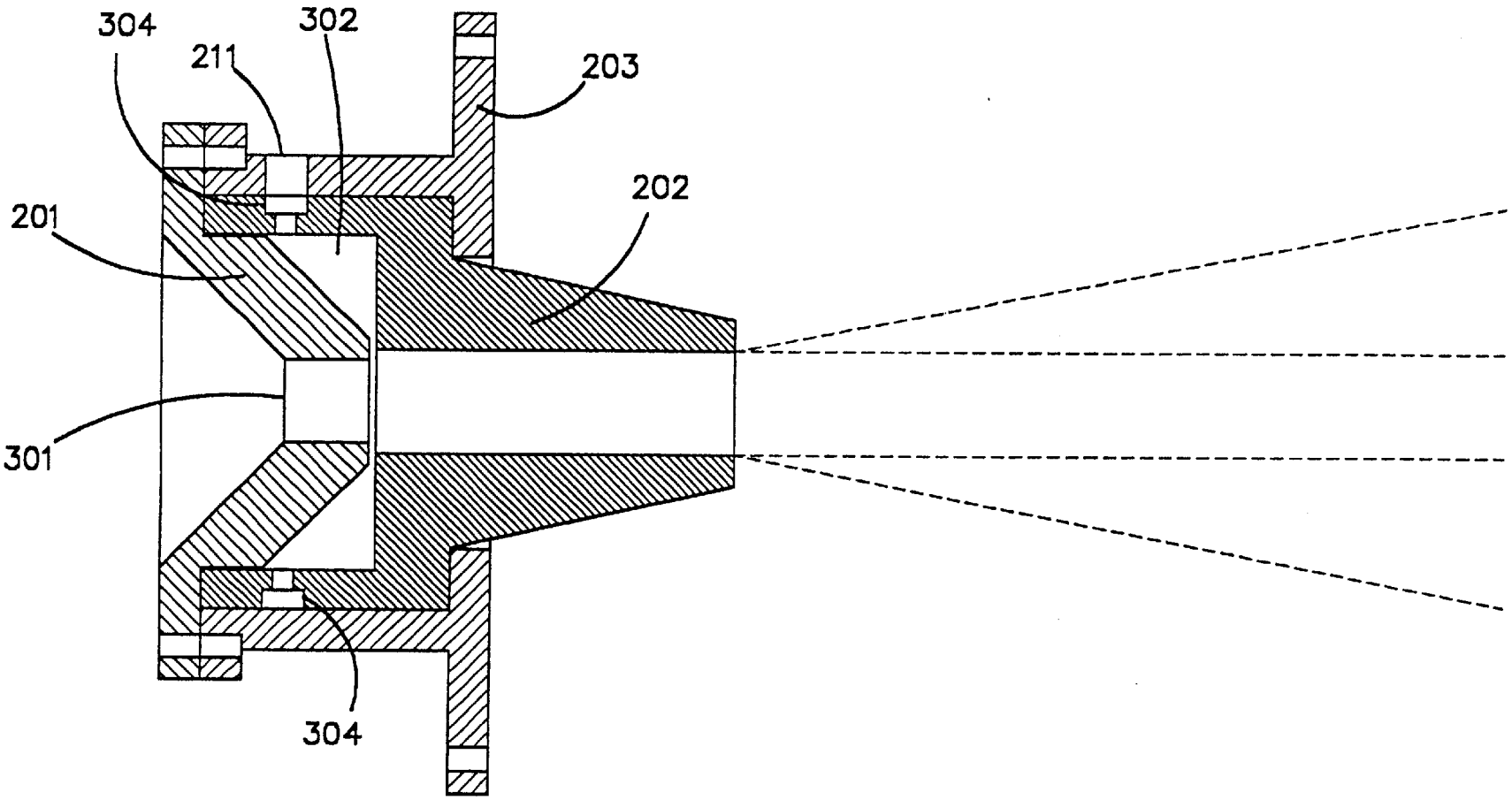
FIG. 4B is a sectional view of an embodiment of the nozzle assembly showing deflection of the liquid jet.

Referring to FIGS. 3, 4A and 4B, in the interior of nozzle housing 203, fluid nozzle 201 includes constricted throat 301. Fluid nozzle 201 is attached by a connecting means to air injection nozzle 202. Air gap 302 exists between constricted throat 301 and air injection nozzle 202. In one embodiment, air gap 302 between constricted throat 301 and air injection nozzle 202 at its narrowest point measures 3/16 of an inch. The overall area and dimension at the narrowest point of air gap 302 will vary with the application and the material being transferred to optimize the suction effect.

Constricted throat 301 is attached to air injection nozzle 202 by means of nozzle housing 203. Nozzle housing 203 is a flanged pipe with air intake 211 drilled into the pipe circumference. Although nozzle housing 203 is depicted with one air intake 211, those skilled in the art would know that multiple air intakes can be provided. In a preferred embodiment, nozzle housing 203 has eight ¾ inch holes equal distance around the circumference of nozzle housing 203.

Air injection nozzle 202 has drilled air hole 304. Although air injection nozzle 202 is depicted with one air hole 304, those skilled in the art would know that multiple air holes can be provided. In a preferred embodiment depicted in FIG. 6, air injection nozzle 202 has eight ½ inch holes equal distance around the circumference of air injection nozzle 202.

When air injection nozzle 202 and fluid nozzle 201 are assembled, air hole 304 can align with air intake 211. Alignment however is not necessary, as fluid nozzle 201 and air injection nozzle 202 should be constructed with a minimal clearance to allow air to surround the fluid jet as it passes through constricted throat 301 into nozzle opening 202. In a preferred embodiment, the clearance is 0.01 inches.

Air hole 304 and air intake 211 allow the entry of atmospheric air to fill air gap 302. The forced delivery of liquid through constricted throat 301 creates a vacuum in air gap 302 that pulls in atmosphere air. Varying the amount of air entering air hole 304 creates an increased suction effect in air gap 302.

In one embodiment, vacuum in air gap 302 measured 29 inches Hg when air intake 211 was 10% open, compared to 10 inches Hg when air intake 211 was 100% open. Restriction of air though air intake 211 can be accomplished by any mechanical valve means.

It is believed that entry of atmospheric air into air gap 302 creates an air bearing effect. The air surrounds the flow of fluid leaving constricted throat 301 and the combined fluid jet with surrounding air passes through air injection nozzle 202.

Figure 5:
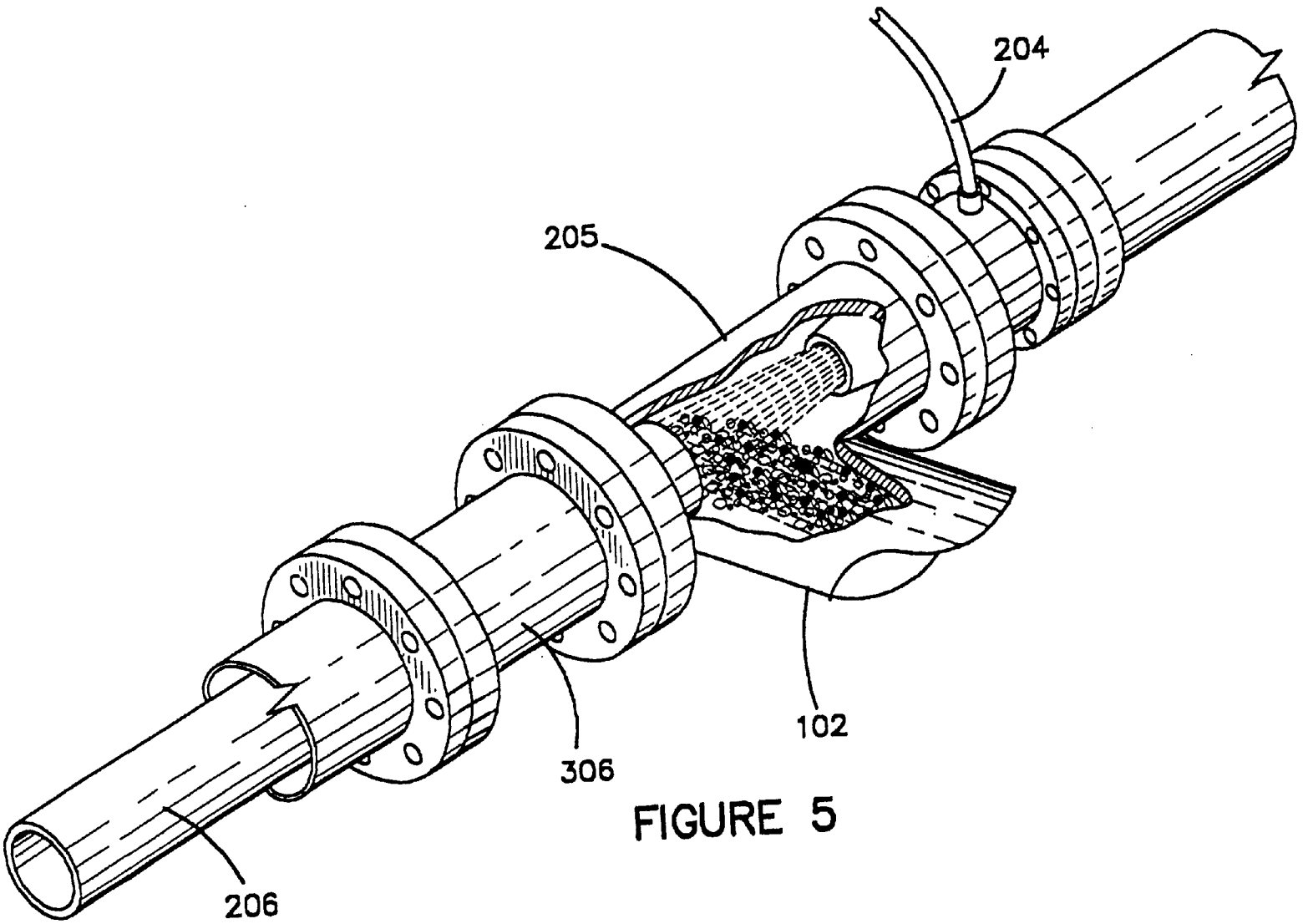
FIG. 5 is a perspective view of material moving through the nozzle assembly and suction chamber.

Referring to FIGS. 2, 3, and 5, the fluid jet with the air, introduced through air gap 302, exits air injection nozzle 202, passes through suction chamber 205, and enters target tube 206. The combined air fluid jet passes through suction chamber 205 with minimal deflection before entering target tube 206.

As illustrated approximately in FIGS. 4A and 4B, a visual correlation can be observed between the deflection of a liquid jet entering target tube 206, and the presence of atmospheric air in air gap 302. FIG. 4A shows the liquid pattern with atmospheric air creating air bearing 401. FIG. 4B depicts the liquid pattern exiting air injection nozzle 202 without atmospheric air present. For the embodiment depicted, the best results for pumping only water were achieved when the pump discharge pressure was 150–175 p.s.i. and the vaccum in air gap 30L was 18–22 inches of Hg.

Air bearing 401 around the liquid jet minimizes deflection, and thus, cavitation in suction chamber 205. Less cavitation reduces wear and the need to replace component parts, and increases flow through suction chamber 205 into target tube 206 with the liquid jet stream.

Referring to FIG. 3, suction chamber 205 is shown with end 102*b* of suction pipe 102 entering at a 45° angle. The design of suction chamber 205 allows one to adjust the placement of air injection nozzle 202 so that air injection nozzle 202 is out of the flow of solid material entering suction chamber 205, so as to prevent wear, or further into suction chamber 205 so as to create a greater vacuum.

Suction pipe 102 entering at an angle avoids the problem common to many eductor nozzles suffering excessive wear and corrosion by being placed in the flow of solid material. Although this configuration is a preferred embodiment to maximize the entry of slurry material with minimal abrasive effect, those skilled in the art would know that alternate angles greater than 0° and less than 180° can be utilized.

In a preferred embodiment, suction chamber 205 measures 24¾ inches at A. The distance between nozzle opening 303 and one end of target tube 206 is 13¾ inches at B.

As the liquid jet passes through target tube 206, a suction effect is created in suction chamber 205. The suction effect pulls in any material located at open end 102*a* of suction pipe 102. The suction effect increases the overall quantity of material driven by pump 104. The following table illustrates the ratio of pumped liquid entering fluid nozzle 201 to total material exiting target tube 206:

| Pump Discharge Pressure (psi) | Vacuum Measured In Air Gap (Hg) | Liquid Exit Power (GPM) | Liquid Inlet Fluid Nozzle (GPM) | Suction Ratio | Discharge Pressure Exit Tube (psi) |
|---|---|---|---|---|---|
| 100 | 25 | 3160 | 672 | 4.70 | 6 |
| 125 | 25 | 3500 | 780 | 4.49 | 7 |
| 150 | 25 | 4150 | 824 | 5.04 | 8 |
| 175 | 25 | 4460 | 890 | 5.01 | 9 |
| 200 | 25 | 4080 | 950 | 4.29 | 9.5 |
| 225 | 25 | 4500 | 1000 | 4.50 | 9.5 |
| 250 | 25 | 4500 | 1063 | 4.23 | 10 |
| 100 | 20 | 3140 | 672 | 4.67 | 6 |
| 125 | 20 | 3700 | 780 | 4.74 | 6 |
| 150 | 20 | 4050 | 824 | 4.92 | 7 |
| 175 | 20 | 4170 | 890 | 4.69 | 8 |
| 200 | 20 | 4150 | 950 | 4.37 | 9 |
| 225 | 20 | 3600 | 1000 | 3.60 | 10 |
| 250 | 20 | 3300 | 1063 | 3.10 | 10 |
| 100 | 15 | 3450 | 672 | 5.13 | 6 |
| 125 | 15 | 3911 | 780 | 5.01 | 6 |
| 150 | 15 | 4041 | 824 | 4.90 | 7 |
| 175 | 15 | 3600 | 890 | 4.04 | 8 |
| 200 | 15 | 3200 | 950 | 3.37 | 9 |
| 225 | 15 | 2300 | 1000 | 2.30 | 10 |
| 250 | 15 | 2700 | 1063 | 2.54 | 10 |

The specific gravity of the material pumped, i.e. water, versus sand or gravel, will affect the optimum inches vacuum in air gap 302 and the discharge pressure of pump 104. During testing of jet pump 107, vacuum in air gap 302 measured 29 inches Hg when suctioning water, 24 inches when suctioning slurry material containing sand, and 18 inches Hg when suctioning material containing gravel.

The suction effect created by target tube 206 allows the movement of larger quantities of material without any concurrent increase in horsepower to operate pump 104 providing the liquid flow. For example, testing has demonstrated movement of material containing 60–65% by weight of sand, as compared to the 18–20% of solids using conventional methods such as centrifugal pumps at the same flowrate or discharge pressure.

Target tube 206 is constructed as a detachable wear plate. The target tube can be detached from outlet pipe 207 and suction chamber 205. The majority of wear from abrasive material occurs in target tube 206, not suction chamber 205, because of reduced cavitation from the air bearing effect on the liquid jet and the design of suction chamber 205.

Figure 6:
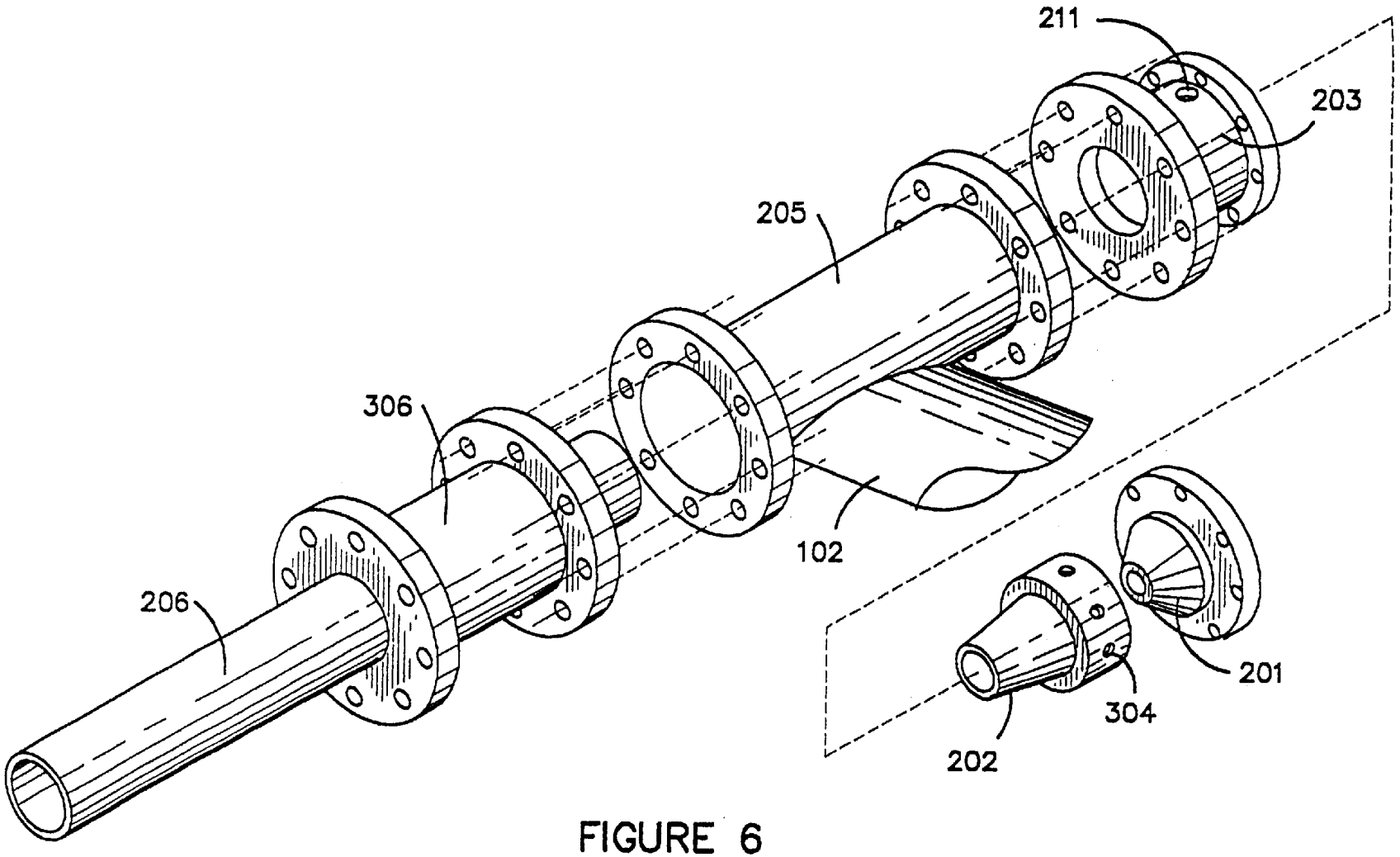
FIG. 6 is a perspective view of a preferred embodiment of the nozzle assembly, suction chamber and target tube of the invention.

In FIGS. 3 and 6, target tube 206 is fixably attached to a support in the form of target tube housing 306. Once target tube 206 is worn, target tube 206 can be removed by detaching target tube housing 306 from suction chamber 205 on one end 306*a* and from outlet pipe 207 on the other end 306*b* without having to open suction chamber 205.

In an alternative embodiment, target tube 206 may be fixably attached at one end to a connecting means such as a split locking flange. The split locking flange could then hold target tube 206 in place at one end by connecting between outlet pipe 207 or suction chamber 205 and target tube housing 306. The opposite end of target tube 206 could then rest on target tube housing 306 using notches or other means to prevent axial or radial movement.

A centrifugal pump 108, as shown in FIG. 1, can be placed downstream of target tube 206 despite the introduction of atmospheric air before nozzle opening 203. No cavitation occurs in centrifugal pump 108 from the atmospheric air. This is counter to conventional wisdom regarding operation of centrifugal pumps by those skilled in the art. The atmospheric air likely dissolves in the liquid jet in or past target tube 206, further supporting the optimum effect observed when atmospheric air is restricted in its entry through air intake 211.

Target tube 206 can vary in both length and diameter. Diameter will most often be determined by the particle size of the material conveyed. Length and diameter of target tube 206 will effect the distance and head pressure that jet pump 107 can generate.

In a preferred embodiment shown in FIG. 6, target tube 206 measures 36 inches in length, with 6⅝ inches outer diameter and 6 inches inner diameter. Target tube housing 306 is composed of 2 6×12 reducing flanges, each connected to one end of 12¾ pipe 10 inches long. Interior target tube wear plate 305 (as shown in FIG. 3) is composed of non-abrasive disposable material such as metals with high chrome content.

As shown in FIG. 6, target tube 206 is a straight pipe with blunt edges. In an alternate embodiment shown in FIG. 2, target tube 206 could have angled edges of a larger diameter than the diameter of the target tube body at one or both ends of target tube 206.

Figure 7:
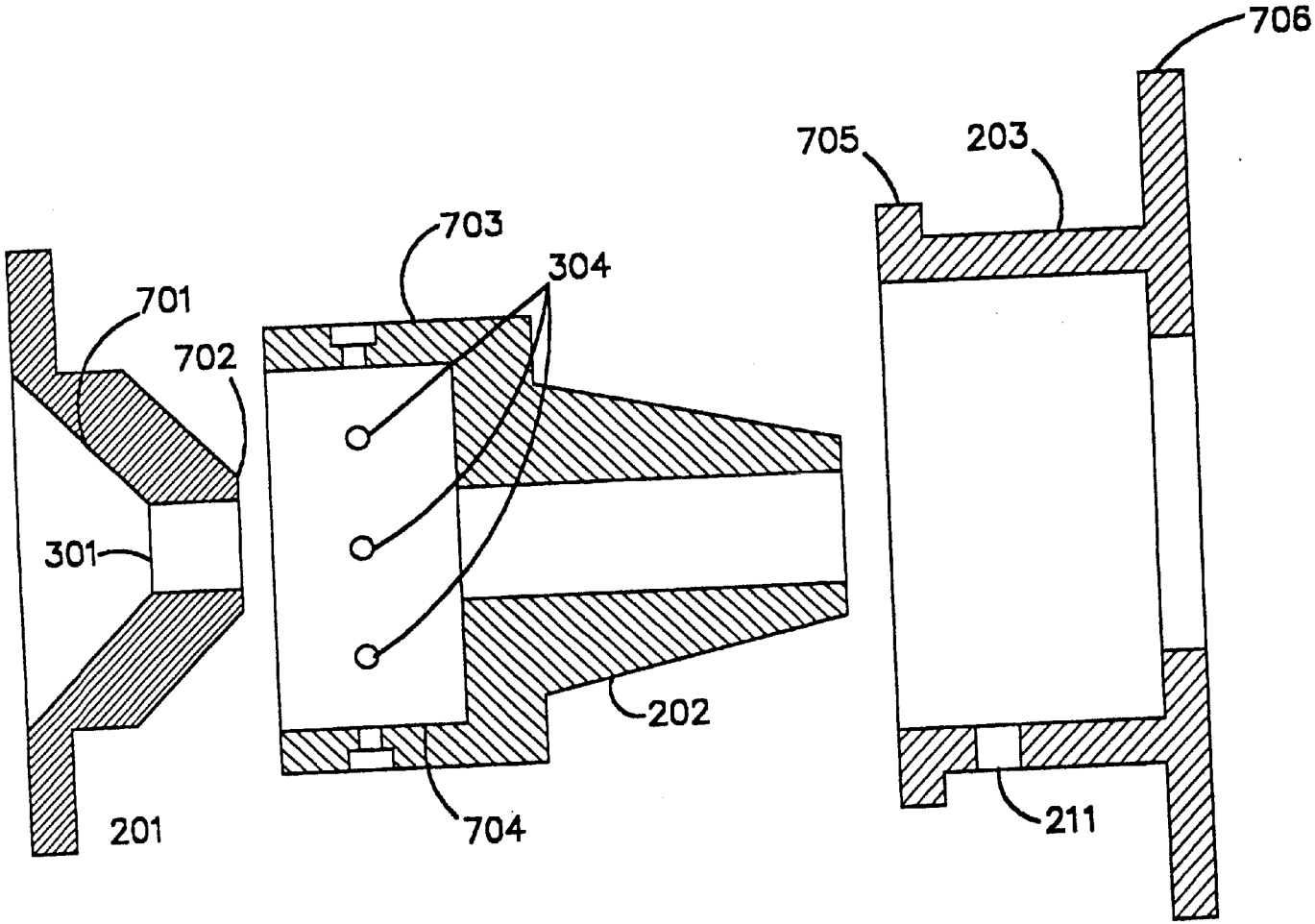
FIG. 7 and FIG. 8 are sectional views of a preferred embodiment of the nozzle assembly of the invention.
Figure 8:
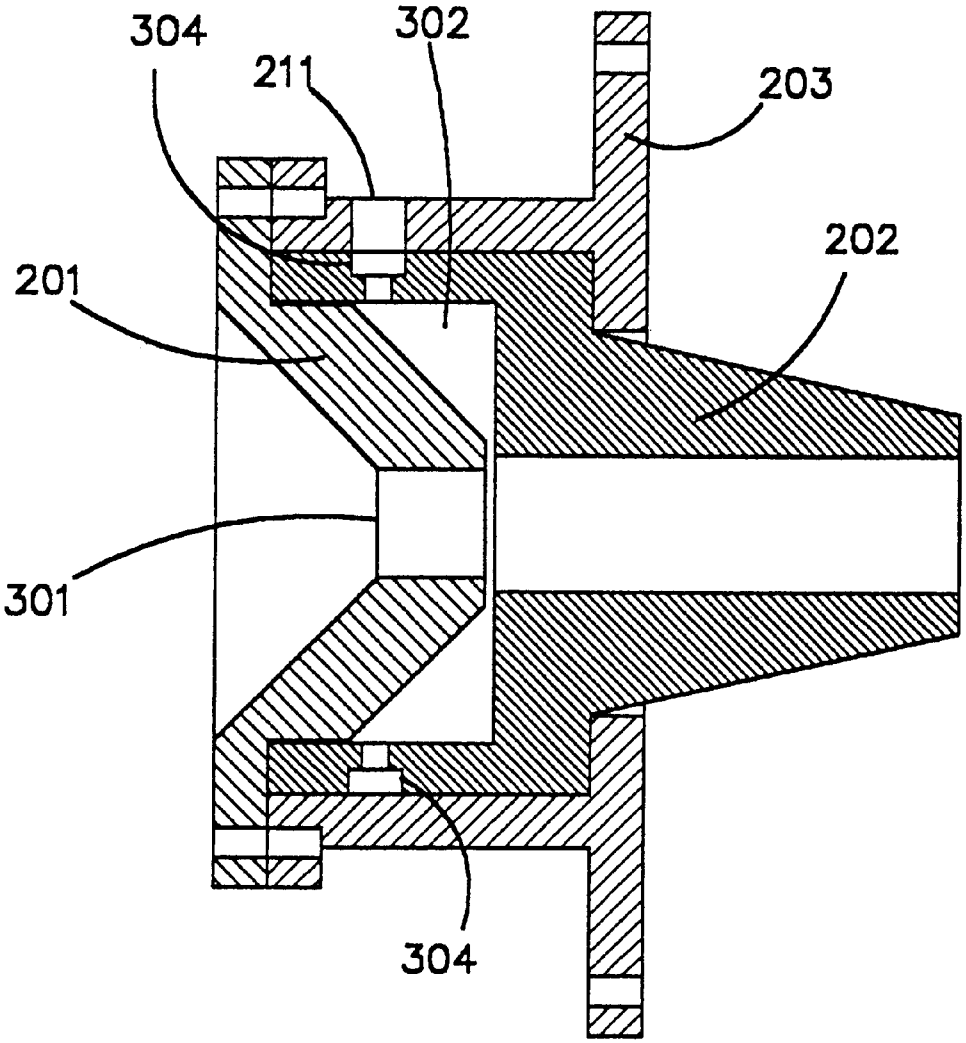

In a preferred embodiment, the nozzle elements of FIG. 7 are constructed according to specific proportions. Although the nozzle elements are shown as three separate elements, those skilled in the art would know that the nozzle assembly could be constructed of one or more elements of varying dimensions. Fluid nozzle 201 is 5 inches in length and 8 inches in outer diameter. Constricted throat 301 of fluid nozzle 201 at inner edge 701 narrows radially inward from 8 inches to 2 inches diameter at its narrowest point at a 45° angle. Constricted throat 301 measures 3 inches in diameter on outer edge 702.

Air injection nozzle 202 is 12 and ⅞ inches in length. At one end, air injection nozzle 202 is 10 inches in diameter on outside surface 703, and 8.01 inches in diameter on inside surface 704. Outside surface 703 remains 10 inches in diameter axially for a length of 5 inches, then drops radially to a diameter of 7 inches, and angles inward radially to a diameter of 4 inches for the remaining length. In a preferred embodiment, air injection nozzle 202 has an angle of 102° between the smallest diameter at angled end in the vertical plane and angled edge.

Inside surface 704 of air injection nozzle 202 remains 8.01 inches axially for a length of 4 and 3/16 inches, then drops radially to a diameter of 2 and ½ inches for the remainder of the length.

Air hole 303 is ½ inch in diameter equally spaced along the circumference of outside surface 703 located 2 inches from the end of air injection nozzle 202 that has a 10 inch diameter.

In a preferred embodiment, nozzle housing 203 measures 13½ inches at flanged end 705 connected to fluid nozzle 201. At flanged end 706 connected to suction chamber 205, the outer diameter measures 19 inches. Flanged end 705 has an inner diameter measures 7.0625 inches, sufficient to allow passage of air injection nozzle 202 at its angled end. Flanged end 705 has an inner diameter for the remaining length of 10.01 inches to accommodate air injection nozzle 202 at its largest point. Nozzle housing 203 has one or more, preferably eight, 1" NPT connections in air intake 211.

While it is understood that the jet pump described herein is characterized by the entry of atmospheric air and a detachable wear plate, it is apparent that the foregoing description of specific embodiments can be readily adapted for various applications without departing from the general concept. Such adaptions and modifications are intended to be comprehended within the range of equivalents of disclosed embodiments. Terminology used herein is for the purpose of description and not limitation.

The invention can be used in any application requiring significant suction effect of solid material in a liquid or gaseous environment. Those skilled in the art would know that the invention can also be used for suction in gaseous or liquid environments without solids present, and maintain a significant suction effect. The invention can also be used in closed loop dewatering applications to remove excess water or moisture from material.

There are, of course, other alternate embodiments which are obvious from the foregoing descriptions of the invention, which are intended to be included within the scope of the invention, as defined by the following claims.

What is claimed is:

1. An eductor jet pump comprising:

a nozzle assembly comprising a nozzle housing defining at least one air hole, a fluid nozzle which defines a constricted throat, and an air injection nozzle which defines a nozzle opening, said fluid nozzle and said air injection nozzle forming an air gap which is in fluid communication with said at least one air hole and which surrounds said constricted throat, said constricted throat terminating at said nozzle opening, said at least one air hole being located on or before said nozzle opening; said nozzle assembly feeding into a suction chamber;

a discharge pipe which feeds into said constricting throat of said nozzle assembly;

a pumping means to force fluid through said discharge pipe and said constricted throat;

an outlet pipe which defines a receiving outlet downstream from said suction chamber;

a suction pipe which defines a suction inlet and which has a first end connected to said suction chamber at an angle greater than 0° and less than 180°, and a second end open to the surrounding environment; wherein said suction chamber is in fluid communication with said receiving outlet, said suction inlet and said nozzle opening of said nozzle assembly.

2. The eductor jet pump of claim 1 further comprising a hose connected to said at least one air hole for feeding atmospheric air into said air gap.

3. The eductor jet pump of claim 2 wherein said receiving outlet is further defined by a concentric wear plate attached to a support with a first end and a second end, said first end of said support detachably connected to said suction chamber; and said second end of said support detachably connected to said outlet pipe.

4. The eductor jet pump of claim 3 wherein said wear plate is detachably connected to said support.

5. The eductor jet pump of claim 3 wherein said wear plate is made of a metal which is highly resistant to abrasion.

6. The eductor jet pump of claim 3 wherein said receiving outlet has a diameter in a ratio of 5:1 to said opening of said nozzle assembly; a diameter in a ratio of 2:1 to said suction chamber; a diameter in a ratio of 0.5:1 to said suction inlet; and a diameter equal to the diameter of said outlet pipe.

7. The eductor jet pump of claim 3 further comprising a jet nozzle, said jet nozzle comprising:

a first end connected to said discharge pipe;

a second end enclosing a venturi and defining at least one air hole opposite said first end for feeding air into said jet nozzle.

8. The eductor jet pump of claim 6 further comprising a jet nozzle air hose for feeding atmospheric air into said at least one air hole.

9. The eductor jet pump of claim 3 wherein said suction inlet is angled at approximately 45° in relation to said suction chamber.

10. The eductor jet pump of claim 3 wherein said receiving outlet feeds the suction of pumping means for receiving and pumping material received through said receiving outlet.

11. The eductor jet pump of claim 2 further comprising a jet nozzle, said jet nozzle comprising:

a first end connected to said discharge pipe; and a second end enclosing a venturi and at least one air hole opposite said first end for feeding air into said jet nozzle.

12. The eductor jet pump of claim 11 further comprising a jet nozzle air hose for feeding atmospheric air to said at least one air hole.

13. The eductor jet pump of claim 11 wherein said suction inlet is angled at 45° in relation to said suction chamber.

14. The eductor jet pump of claim 11 wherein said receiving outlet feeds the suction of pumping means for receiving and pumping material received through said receiving outlet.

15. An eductor jet pump comprising:

a nozzle assembly comprising a nozzle housing defining a plurality of air holes, a fluid nozzle which defines a constricted throat, and an air injection nozzle which defines a nozzle opening, said fluid nozzle and said air injection nozzle forming an air gap which is in fluid communication with said air holes and which surrounds said constricted throat, said constricted throat terminating at said nozzle opening, said air holes being located on or before said nozzle opening;

a pipe providing an inlet to said constricting throat of said nozzle assembly;

a pumping means to force fluid through said constricted throat;

a concentric wear plate which defines a receiving outlet and is attached to a support with a first end and a second end, said first end of said support detachably connected to said suction chamber; and said second end of said support detachably connected to an outlet pipe;

a suction pipe which defines a suction inlet and which has a first end connected to said suction chamber at an angle greater than 0 and less than 180° degrees, and a second end open to the surrounding environment; and a suction chamber which encloses said receiving outlet, said suction inlet and said nozzle opening on said nozzle assembly.

16. The eductor jet pump of claim 15 wherein said receiving outlet has a diameter in a ratio of 5:1 to said opening of said nozzle assembly; a diameter in a ratio of 2:1 to said suction chamber; a diameter in a ratio of 0.5:1 to said suction inlet; and a diameter equal to the diameter of said outlet pipe.

17. The eductor jet pump of claim 15 wherein said wear plate is detachably connected to said support.

18. The eductor jet pump of claim 15 wherein said wear plate is made of a metal which is highly resistant to abrasion.

19. The eductor jet pump of claim 15 further comprising a jet nozzle, said jet nozzle comprising:

a first end connected to said discharge pipe; and a second end enclosing a venturi and defining at least one air hole opposite said first end for feeding air into said jet nozzle.

20. The eductor jet pump of claim 19 further comprising a jet nozzle air hose for feeding atmospheric air to said at least one air hole.

21. The eductor jet pump of claim 15 wherein said suction inlet is angled at 45° in relation to said suction chamber.

22. The eductor jet pump of claim 15 wherein said receiving outlet feeds the suction of pumping means for receiving and pumping material received through said receiving outlet.

* * * * *